US005673011A

United States Patent [19]

Okihara et al.

[11] Patent Number: 5,673,011

[45] Date of Patent: Sep. 30, 1997

[54] SURFACE MOUNT TYPE LEADLESS ELECTROMAGNETIC RELAY

[75] Inventors: Naoto Okihara; Katsuto Kojima; Masayuki Morimoto; Matsujiro Ikeda; Naohiro Tanioka, all of Tokyo, Japan

[73] Assignee: NEC Corporation, Tokyo, Japan

[21] Appl. No.: 617,425

[22] Filed: Mar. 18, 1996

[30] Foreign Application Priority Data

Mar. 20, 1995 [JP] Japan ..... 7-060890

[51] Int. Cl.[6] ..... H01H 51/22

[52] U.S. Cl. ..... 335/78; 335/128

[58] Field of Search ..... 335/78–86, 124, 335/128, 131

[56] References Cited

U.S. PATENT DOCUMENTS

| | | | |
|---|---|---|---|
| 4,731,597 | 3/1988 | Hinrichs | 335/128 |
| 5,153,543 | 10/1992 | Hitachi et al. | 335/78 |
| 5,337,029 | 8/1994 | Nobutoki et al. | 335/83 |
| 5,473,297 | 12/1995 | Sako et al. | 335/78 |

FOREIGN PATENT DOCUMENTS

| | | |
|---|---|---|
| 1-107838 | 7/1989 | Japan . |
| 1-109158 | 7/1989 | Japan . |
| 3-30411 | 2/1991 | Japan . |
| 4-149924 | 5/1992 | Japan . |

*Primary Examiner*—Lincoln Donovan
*Attorney, Agent, or Firm*—Young & Thompson

[57] ABSTRACT

In a surface mount type leadless electromagnetic relay, movable contacts, movable contact springs, stationary contacts and terminals which are electrically connected to external circuit from coils are formed integrally with a base formed of an insulating material. The terminals are extended to the bottom of the body of the relay. The entire relay has a height and a mounting area which are respectively equal to the height and mounting area of its body.

16 Claims, 12 Drawing Sheets

SURFACE MOUNT TYPE LEADLESS ELECTROMAGNETIC RELAY

BACKGROUND OF THE INVENTION

The present invention relates to a surface mount type electronic device and, more particularly, to a surface mount type leadless electromagnetic relay.

Among electronics mounting technologies, a surface mounting technology is extensively used for the assembly of various kinds of electronic devices. For example, a leadless electromagnetic relay implemented by the surface mounting technology is conventional. Usually, the leadless electromagnetic relay is provided with so-called gull-wing terminals. However, the problem with the gull-wing terminals is that they protrude downward from the bottom of the relay body and bend to the outside of the relay body. As a result, the actual mounting height and mounting width of the entire relay are respectively greater than the height and width of the relay body.

SUMMARY OF THE INVENTION

It is therefore an object of the present invention to provide a surface mount type leadless electromagnetic relay whose mounting height and mounting area are reduced.

In accordance with the present invention, a surface mount type leadless electromagnetic relay has a coil assembly having an iron core, a coil spool containing the iron core such that the iron core is partly exposed to the outside, and coils wound round the coil spool. An armature assembly has an armature contacting at least one end portion of the iron core at one end portion thereof, movable contact springs each having at least one movable contact at an end thereof, and a support formed of an insulating material and supporting the armature and movable contact springs. A terminal assembly has terminals including stationary contact terminals each holding at least one stationary contact facing the movable contact. A base is formed of an insulating material and accommodates the coil assembly therein. The movable contacts, movable contact springs, stationary contacts and terminals of the terminal assembly, which are electrically connected to external circuit from the coils are formed integrally with the base and held in close contact with the bottom of the body of the relay.

Also, in accordance with the present invention, a surface mount type leadless electromagnetic relay has a coil assembly having an iron core, a coil spool containing the iron core such that the iron core is partly exposed to the outside, and coils wound round the coil spool. An armature assembly has an armature contacting at least one end portion of the iron core at one end portion thereof, movable contact springs each having at least one movable contact at an end thereof, and a support formed of an insulating material and supporting the armature and movable contact springs. A terminal assembly has terminals including stationary contact terminals each holding at least one stationary contact facing the movable contact. An upper base is formed of an insulating material, and accommodates the coil assembly. A lower base is formed of an insulating material and has on a surface thereof surface terminals formed in a preselected pattern by plating, metal film application or the like and corresponding to the movable contacts, movable contact springs, stationary contacts, and terminals of the terminal assembly electrically connected to external circuit from the coils. The upper base and lower base are mechanically and electrically connected to each other, and the surface terminals are extended to the bottom of a body of the relay.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
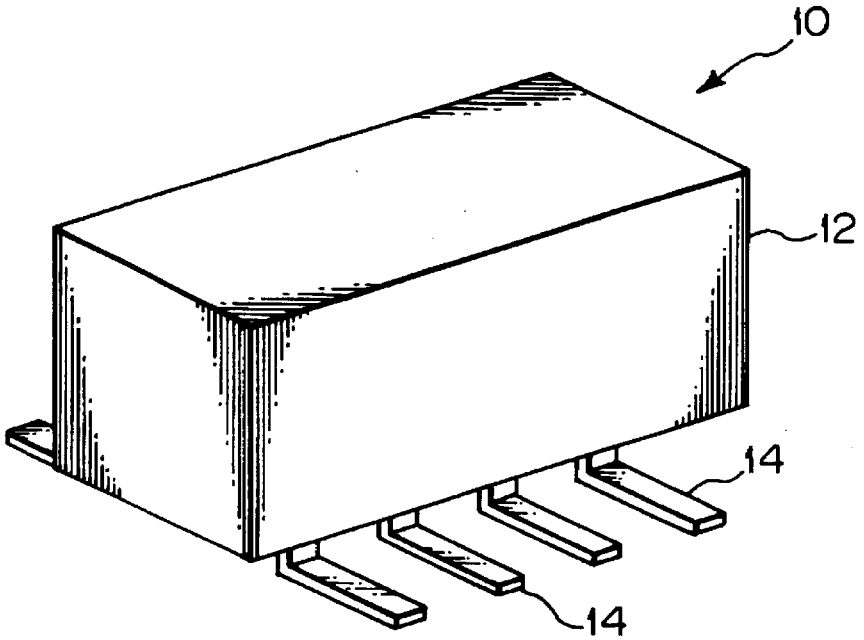
Fig. 1A PRIOR ART
FIG. 1A is an external perspective view showing the general basic structure of a conventional electromagnetic relay having gull-wing terminals.
Figure 1B:
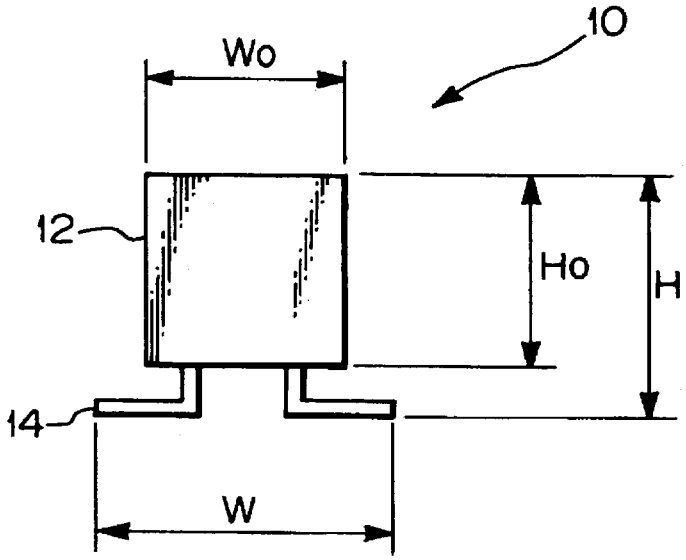
Fig. 1B PRIOR ART
FIG. 1B a side elevation of the relay shown in FIG. 1A.

To better understand the present invention, a brief reference will be made to a conventional surface mount type leadless electromagnetic relay, shown in FIGS. 1A and 1B. As shown, the relay, generally 10, has a body 12 and gull-wind terminals 14. Each gull-wing terminal 14 is implemented by a terminal piece bent in the form of a letter L and extends out from the body 10. This brings about a problem that the mounting area of the relay 10 is greater than the bottom area of the body 12. Specifically, as shown in FIG. 1B, the relay 10 has a mounting width W greater than the width $W_0$ of the body 12. Another problem is that because the terminals 14 protrude from the bottom of the body 12, the relay 10 has a height greater than the height of the body 12. Specifically, as shown in FIG. 1B, the relay 10 has a height H greater than the height $H_0$ of the body 12.

A reference will be made to FIG. 2 for describing the basic structure of a conventional relay of the type described. As shown, the relay, generally 20, has a casing 100, a coil assembly 200, a terminal assembly 300, and an armature assembly 400. The coil assembly 200 includes a coil spool 203 in which a generally U-shaped iron core 201 and coil terminals 202 are embedded. The coil spool 203 is formed of an insulating material. Coils 204 are wound round the coil spool 203. A permanent magnet 206 is fixedly received in a bore 205 formed in the intermediate portion of the core 201. The armature assembly 400 has movable contact springs 401 each having a movable contact 401*a* at its free end and a hinge spring 401*b* at its center, an armature 402, and a support 403 molded integrally with and supporting the contact springs 401 and armature 402. The terminal assembly 300 has a base 301 formed of an insulating material, stationary contact terminals 302 each having a stationary contact 302 fixed thereto, neutral terminals 303, and coil lead-out terminals 304. The base 301 is provided with a bottom-open box-like configuration and formed with two holes 305 and one hole 306 in the top thereof. The holes 305 accommodate the opposite ends of the U-shaped core 201 while the hole 306 accommodates the permanent magnet 206.

The relay 20 is assembled by the following procedure. First, the coil assembly 200 is inserted into the bottom of the base 301 of the terminal assembly 300, and the coil terminals 202 and coil lead-out terminals 304 are welded or otherwise connected together. Subsequently, the lower portion of the coil assembly 200 is covered with a top-open base 101 constituting the casing 100 and formed of an insulating material. In this sense, the bases 301 and 101 constitute an upper base and a lower base, respectively. The upper base 301 and lower base 101 are coupled or otherwise affixed to each other. After the armature assembly 400 has been mounted to the top of the upper base 301, the hinge springs 401*b* and neutral terminals 303 are affixed to each other. A lug, not shown, protrudes from the intermediate portion of the bottom of the armature 402 and contacts the top of the magnet 206, so that the armature assembly 400 is fulcrumed by the lug during its tilting movement. After a cover, not shown, has been fitted on the above assembly, the terminals are bent in the gull-wing configuration, as shown in FIGS. 1A and 1B.

Figure 3:
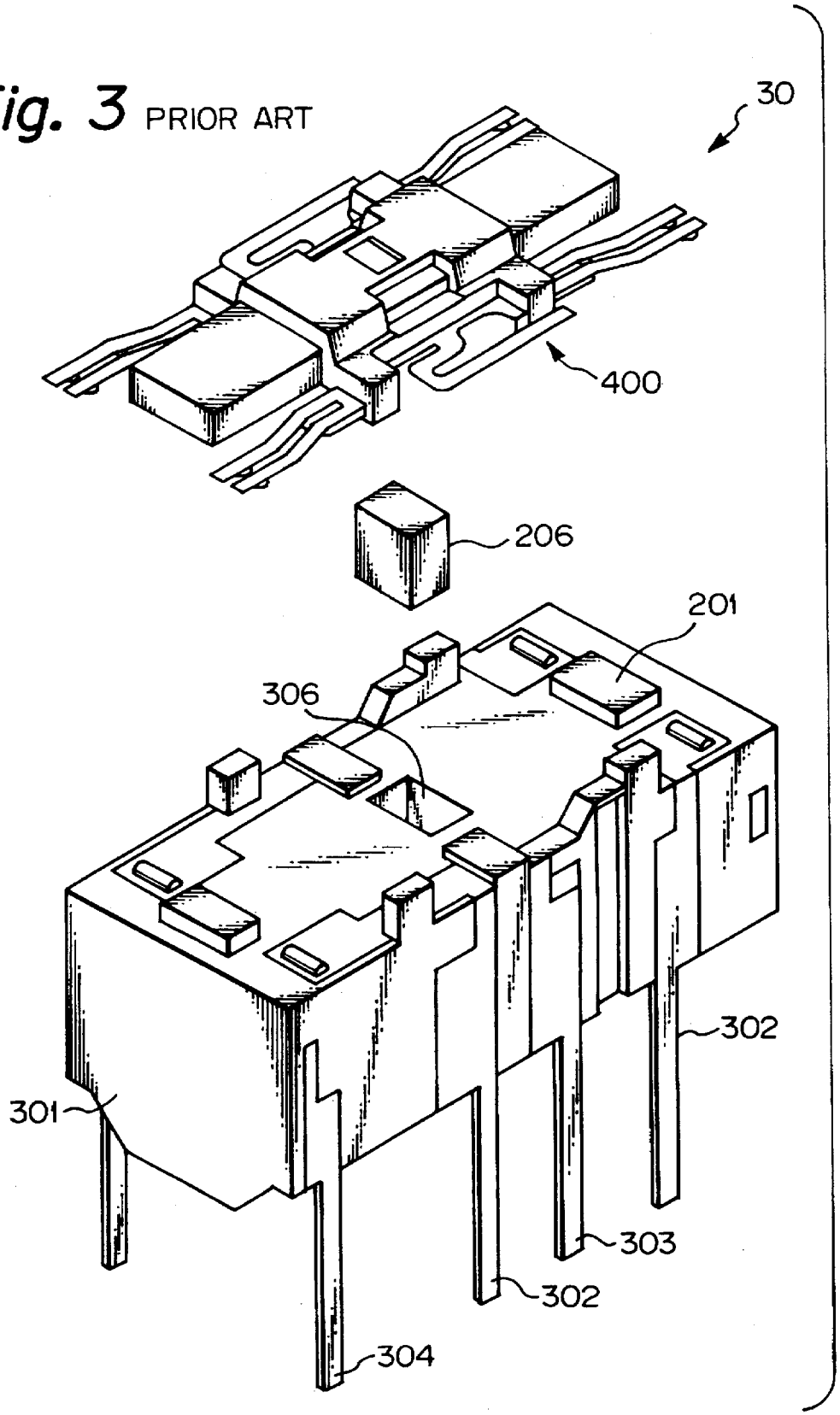
Fig. 3 PRIOR ART
FIG. 3 is an external perspective view showing the basic structure of still another conventional relay.

FIG. 3 shows the basic structure of another conventional relay of the type described and taught in Japanese Patent Laid-Open Publication No. 4-149924 corresponding to U.S. Pat. No. 5,153,543. As shown, the relay, generally 30, is similar to the relay 20 except that the coil terminals 202 are affixed to the coil lead-out terminals 304 beforehand, and then the coil assembly 200 is molded integrally with the base 301. The permanent magnet 306 is received in the hole 306 of the base 301. The armature assembly 400 is mounted on the top of the magnet 206. This is followed by the same procedure as described in relation to the relay 20. After a cover, not shown, has been fitted on the above assembly, the terminals 302, 303 and 304 are bent, as shown in FIGS. 1A and 1B.

Japanese Utility Model Laid-Open Publication No. 1-107838 discloses a relay of the type described and made up of a complete relay body having straight terminals, and a socket having gull-wing terminals and produced independently of the relay body. The relay body is mounted on the socket. This kind of scheme, however, brings about a problem that the height of the socket increases the overall height of the relay. The mounting area cannot be reduced because the socket has the gull-wing terminals.

A method of producing a solid-state electrolytic capacitor, which is another leadless device, is taught in Japanese Patent Laid-Open Publication No. 3-30411. In accordance with this method, terminals are bent on the bottom of a capacitor body, so that the original mounting height and mounting area of the capacitor body are achievable. However, because the terminals are bent after the molding of the capacitor body, it is likely that they move away from the capacitor body and are distorted.

Further, Japanese Patent Laid-Open Publication No. 1-109158 proposes a structure for mounting an electronic apparatus by using the surface mounting technology. In the proposed structure, an auxiliary fixing plate is mounted on the rear of a flexible printed wiring board. Lugs protrude from the bottom of the body of the apparatus and pierce the wiring board into the auxiliary board, thereby enhancing reliable connection. However, this kind of scheme cannot reduce the mounting height and area of the surface mounted apparatus.

Preferred embodiments of the leadless electromagnetic relay in accordance with the present invention will be described hereinafter. In the embodiments, the same or similar constituents as or to the constituents shown in FIGS. 2 and 3 are designated by the same reference numerals, and a detailed description thereof will not be made in order to avoid redundancy.

Figure 4A:
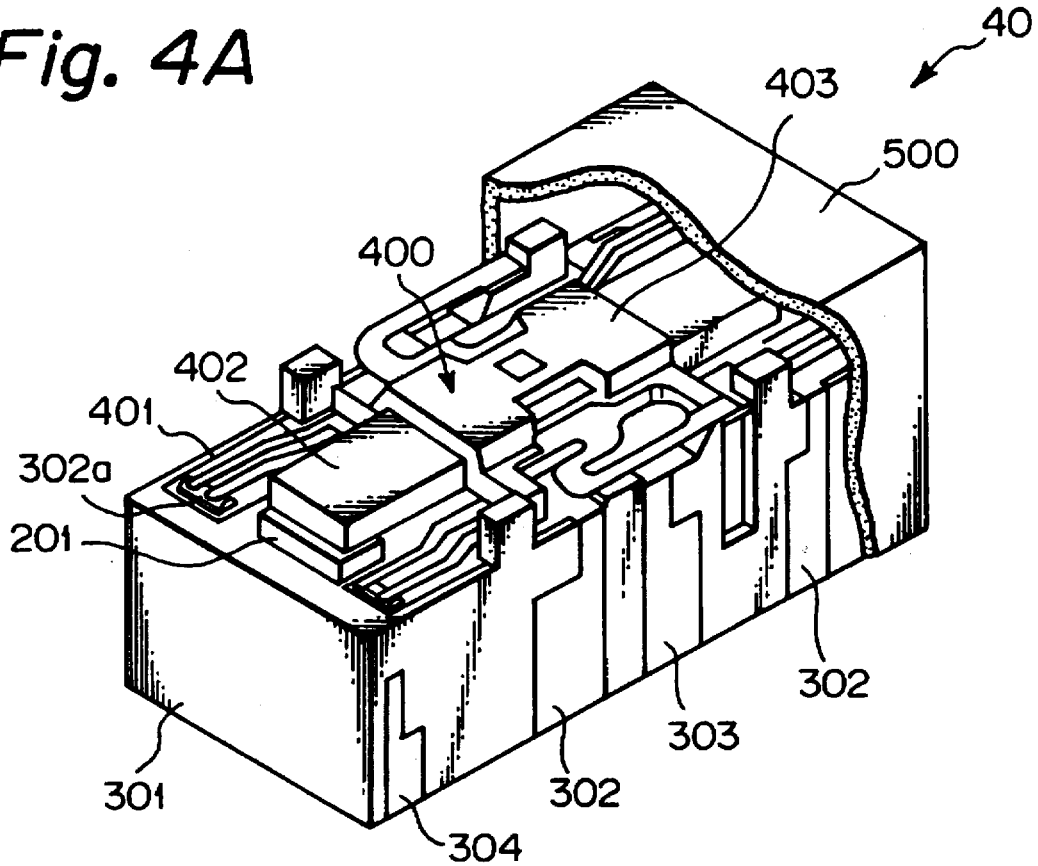
FIGS. 4A and 4B are perspective views showing a first embodiment of the surface mount type leadless electromagnetic relay in accordance with the present invention.
Figure 4B:
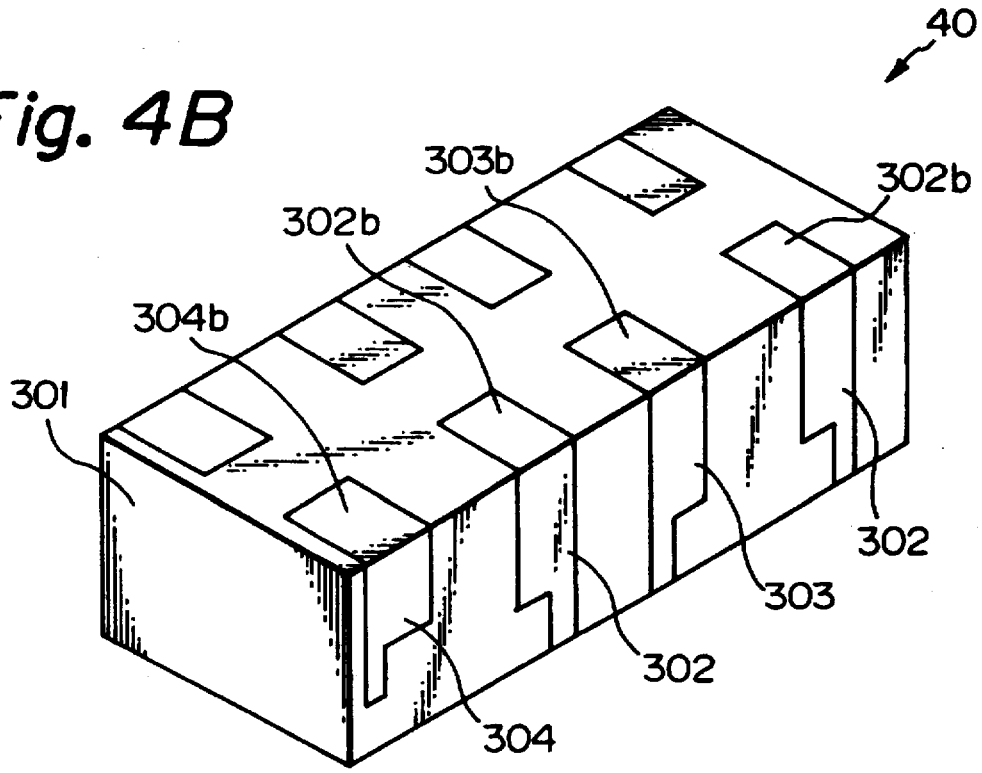

Referring to FIGS. 4A and 4B, a first embodiment of the present invention is shown. FIG. 4A shows a relay 40 as seen from above while FIG. 4B shows it as seen from below and in which a cover 500 is absent. The relay 40 is similar in basic structure to the relay 30 of FIG. 3 except for the following. As shown, after coil terminals 202 have been affixed to the coil lead-out terminals 304, stationary contact terminals 302, neutral terminals 303 and the terminals 304 are bent inwardly of the relay 40. Subsequently, a base 301 formed of an insulating material is molded integrally with a coil assembly 200. Because the terminals 302, 303 and 304 are molded integrally with and in close contact with the base 301, they are prevented from moving away from the base 301 or from being distorted. As shown in FIG. 4B, the portions of the terminals 302, 303 and 304 bent inwardly and positioned on the bottom of the base 301 constitute extensions 302*b*, 303*b* and 304*b* corresponding to solder pads provided on a printed circuit board to which the relay 40 will be mounted.

As stated above, the terminals of the relay 40 do not protrude to the outside of the relay body, so that the mounting width of the relay is equal to the width of the relay body. In addition, because the terminals do not project from the bottom of the relay body, the mounting height of the relay is equal to the height of the relay body.

Figure 5A:
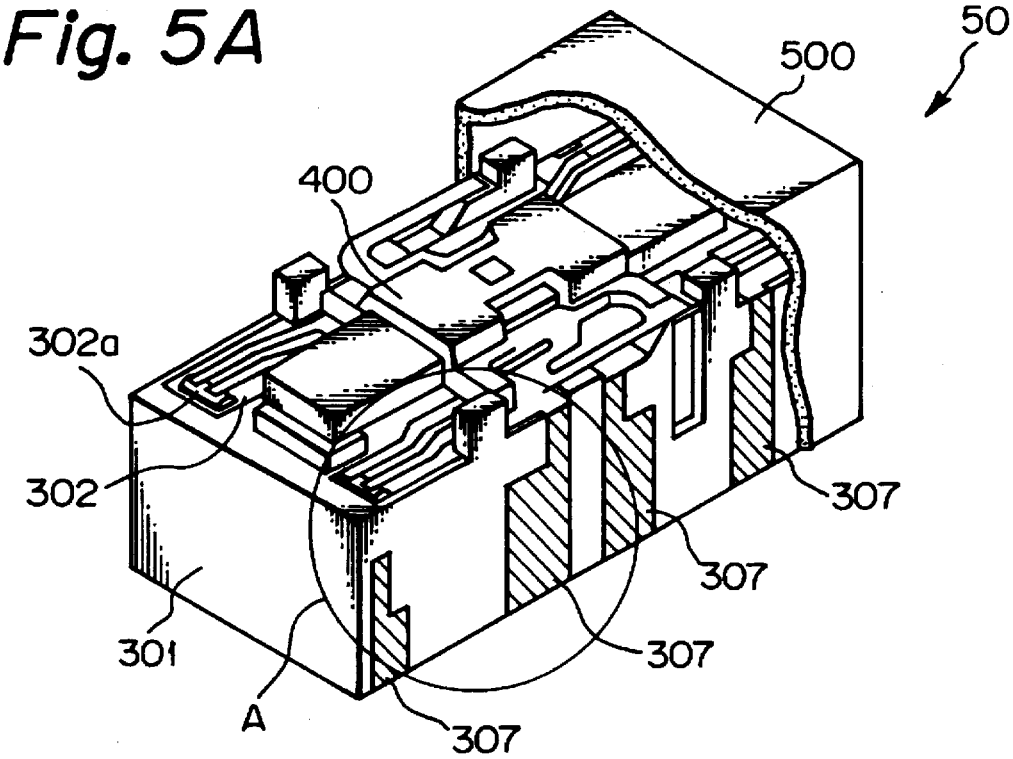
FIGS. 5A and 5B are respectively a perspective view and a fragmentary enlarged view showing a second embodiment of the present invention.
Figure 5B:
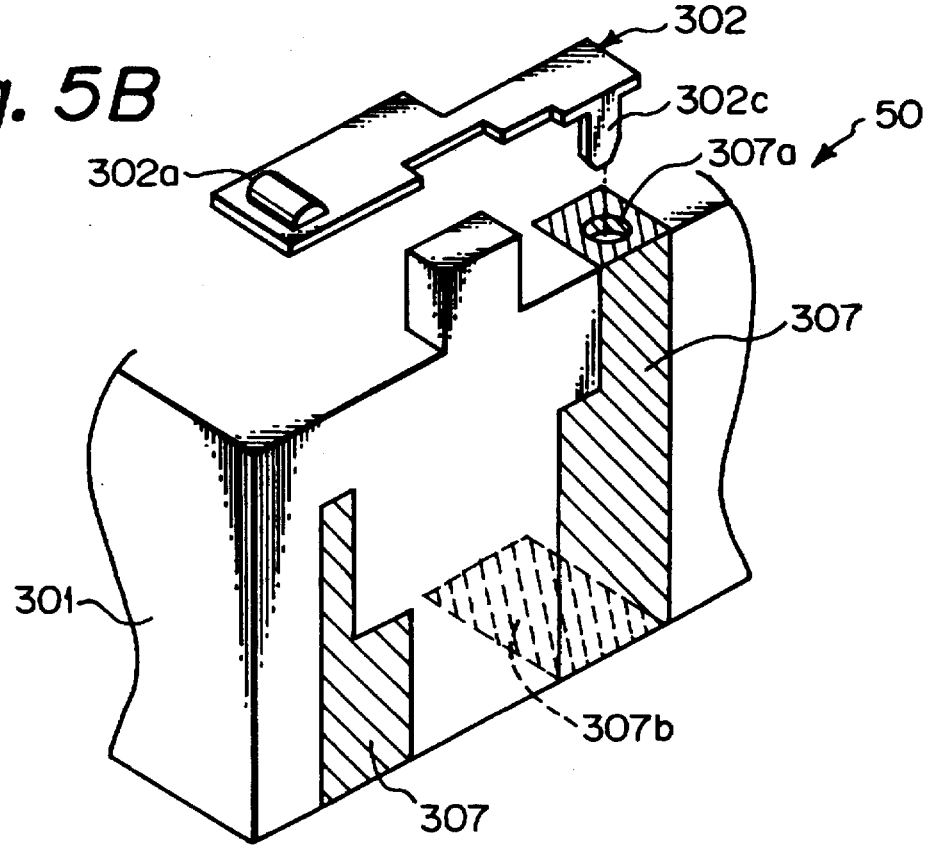

FIG. 5A shows a second embodiment of the present invention while FIG. 5B shows a portion of the embodiment labeled A in FIG. 5A. This embodiment is similar to the first embodiment except for the following. As shown, a relay 50 has surface terminals 307 in the form of stripes and formed on the top, sides and bottom of the base 301 by plating, metal thin film application or similar technology. As shown in FIG. 5B, the stationary contact terminals 302 has a downwardly extending lug 302*c*. The lug 302*c* is press-fitted in a hole 307*a* formed in the part of corresponding one of the terminals 302 which is positioned on the top of the base 301. Terminals 302 and 307 are mechanically and electrically connected to each other by the press-fitting of the lugs 302*c* in the corresponding holes 307*a*. The portion of each surface terminal 307 located on the bottom of the base 301 constitutes an extension 307*b*.

Figure 6:
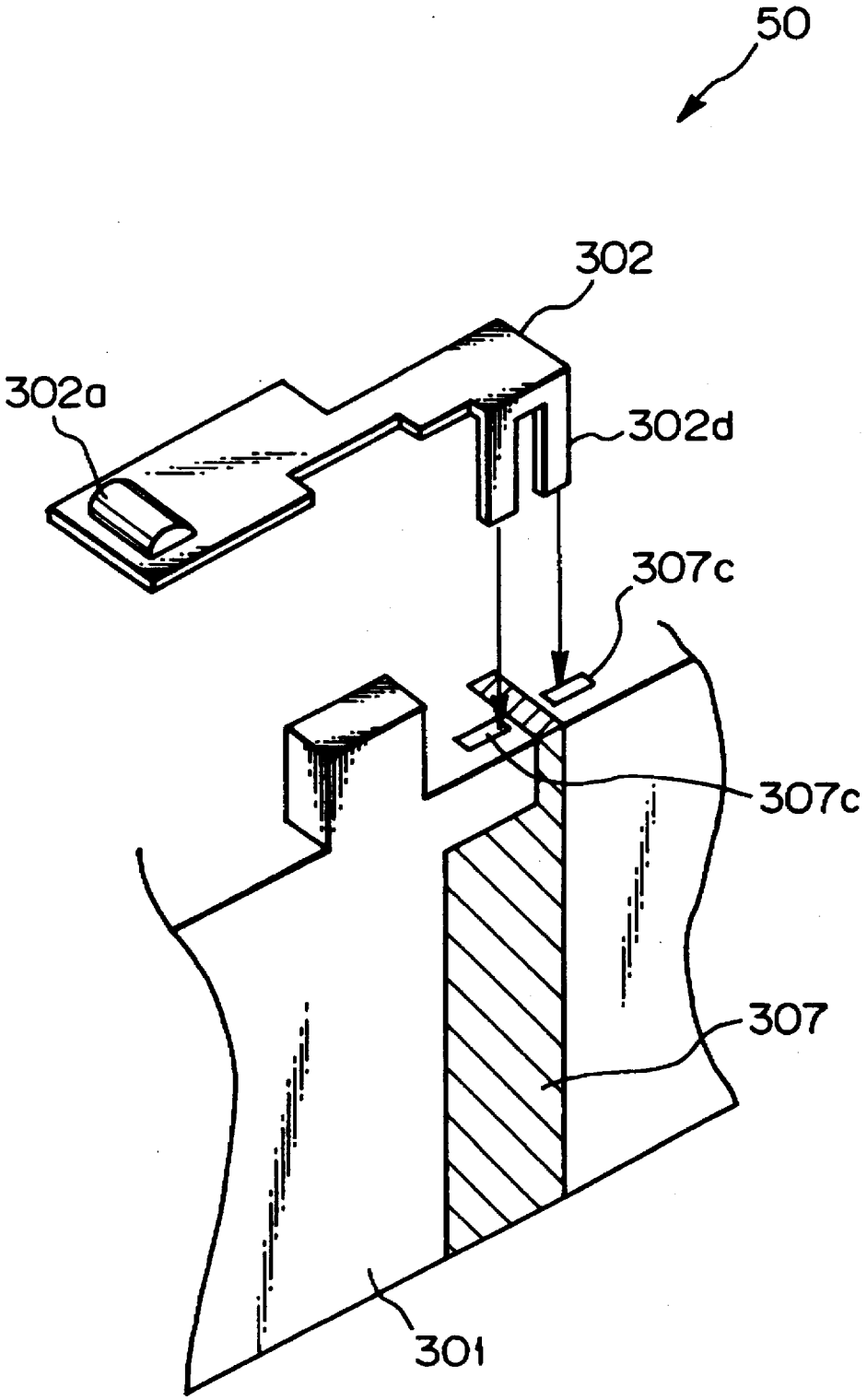
FIG. 6 is a fragmentary enlarged perspective view showing a modification of the second embodiment.

FIG. 6 shows a modification of the press-fitting scheme shown in FIG. 5B. As shown, the stationary contact terminal 302*d* has a bifurcated lug 302*d*. Two holes 307*c* for press-fitting the bifurcated ends of the lug 302*d* are formed in the top of the base 301 at the outside of the surface terminal 307. By press-fitting the ends of the lug 302*d* in the holes 307*c*, it is possible to achieve the same advantages as described in relation to the structure of FIG. 5B. It is to be noted that the shape and number of mating ends of the lug 302*d* and those of the holes 307*c* are open to choice.

Figure 7A:
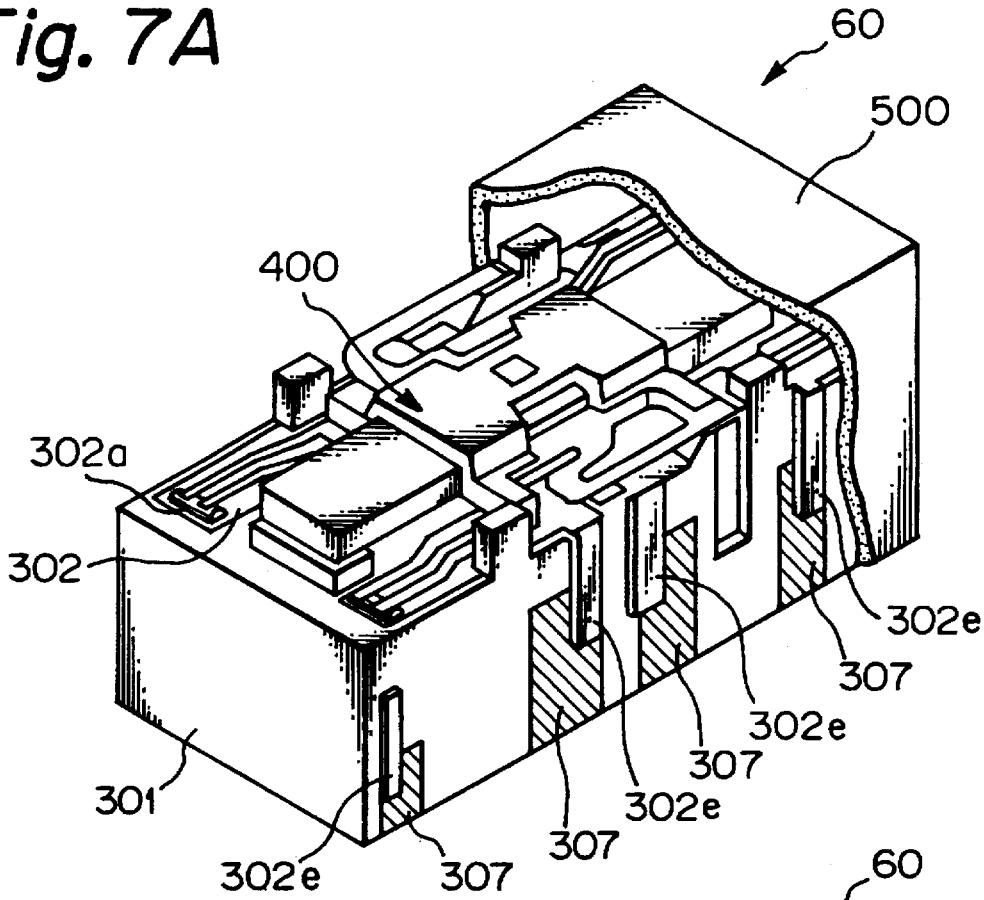
FIGS. 7A and 7B are perspective views showing a third embodiment of the present invention.
Figure 7B:
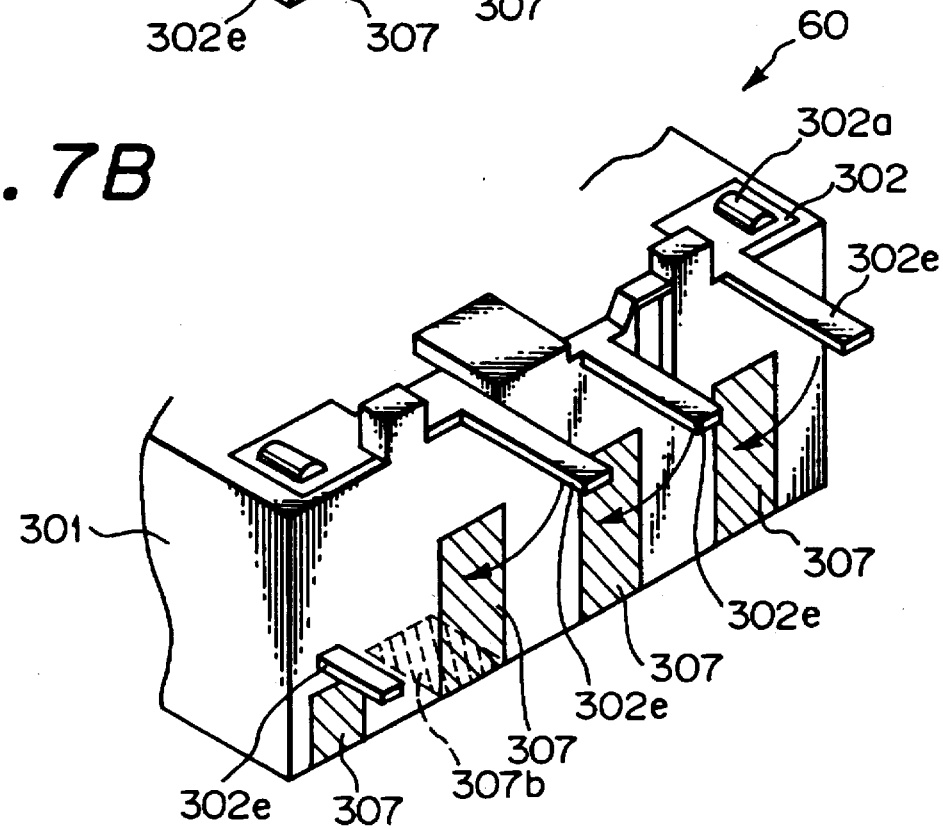

FIG. 7A shows a third embodiment of the present invention while FIG. 7B shows it without the cover 500. As shown, a relay 60 differs from the second embodiment in that the surface terminals 307 in the form of stripes are formed on the sides and bottom of the base 301, and in that tongues 302*e* extending out from the stationary contact terminals 302 are bent to contact the portions of the surface terminals 307 positioned on the sides of the base 301. The portions of the terminals 307 contacting the bottom of the base 301 constitute the extensions 307*b*.

Figure 8A:
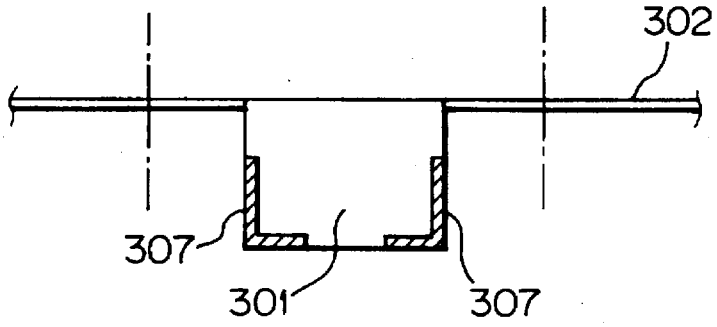
FIGS. 8A–8D are sections showing modifications of the third embodiment.
Figure 8B:
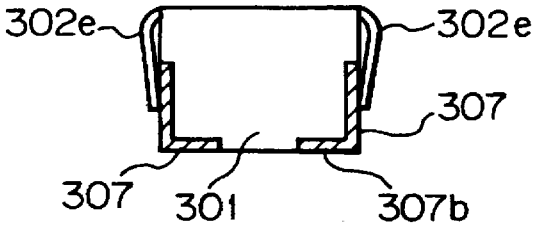
Figure 8C:
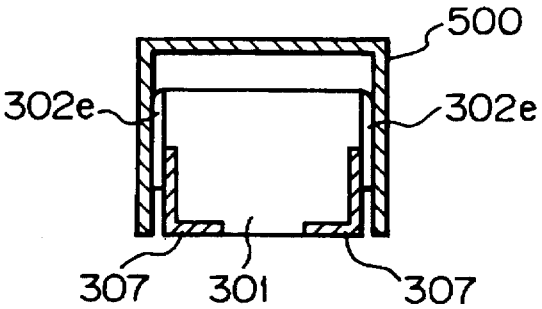

FIGS. 8A and 8B demonstrate a procedure for encasing the relay body of FIGS. 7A and 7B in the cover 500. As shown in FIG. 8A, the stationary contact terminals 302 are each contiguous with one side of the base 301. The terminals 302 are cut off at positions indicated by dash-and-dot lines in FIG. 8A, so that they turn out the tongues 302*e* shown in FIG. 8B. The tongues 302*e* are bent downward such that their free ends contact the surface terminals 307. Subsequently, the cover 500 is fitted on the relay body from above, as shown in FIG. 8C. The cover 500 reinforces the positive contact of the tongues 302*e* with the surface terminals 307.

Figure 8D:
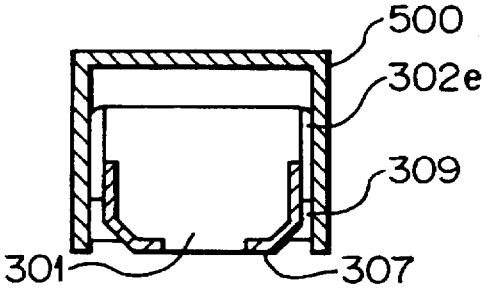

FIG. 8D shows a modification of the base 301 in the condition shown in FIG. 8C. As shown, the opposite bottom corners of the base 301 are inclined so as to form clearances between them and the cover 500. In this configuration, a sealant 309 can be injected into the clearances. This modification is identical in effect with the above embodiment.

Figure 9A:
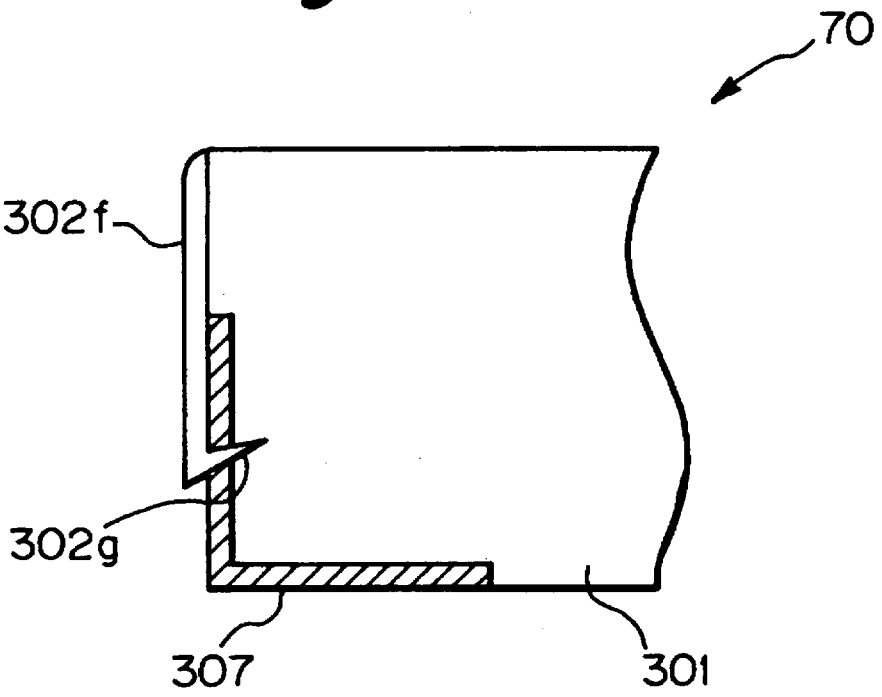
FIGS. 9A and 9B are sections showing a fourth embodiment of the present invention.
Figure 9B:
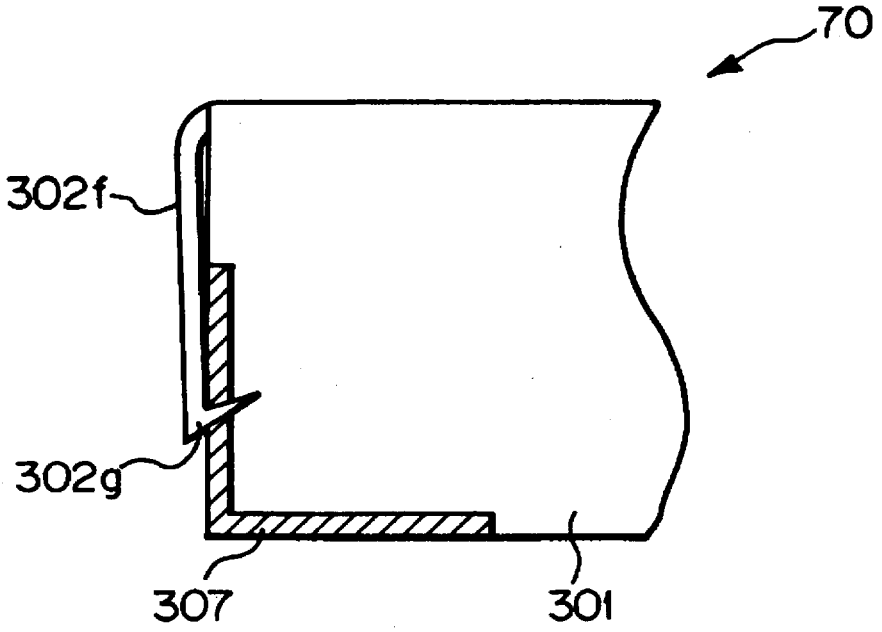

FIGS. 9A and 9B show a fourth embodiment of the present invention, particularly the base 301 included in a relay 70. This embodiment is similar to the third embodiment of FIGS. 7A and 7B except that each tongue 302*f* has a hook-shaped end 302*g*. The hookshaped end 302*g* pierces the associated surface terminal 307 and bites into the base 301, thereby connecting the tongue 302*f* to the surface terminal 307 electrically and mechanically. As shown in FIG. 9B, a clearance may be provided between the end of the tongue 302*f* opposite to the hook-shaped end 302*g* and the base 301. The gist is that the hook-shaped end 302*g* pierces the surface terminal 307 and bites into the base 301.

Figure 10A:
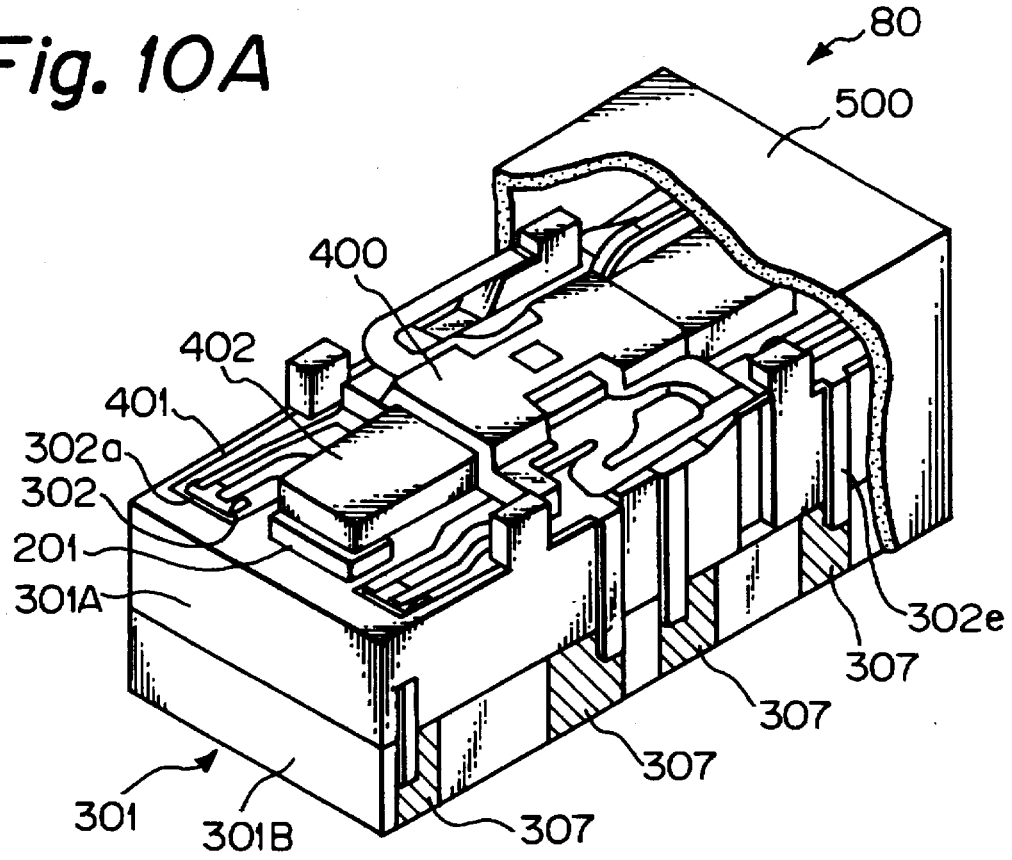
FIGS. 10A and 10B show a fifth embodiment of the present invention.
Figure 10B:
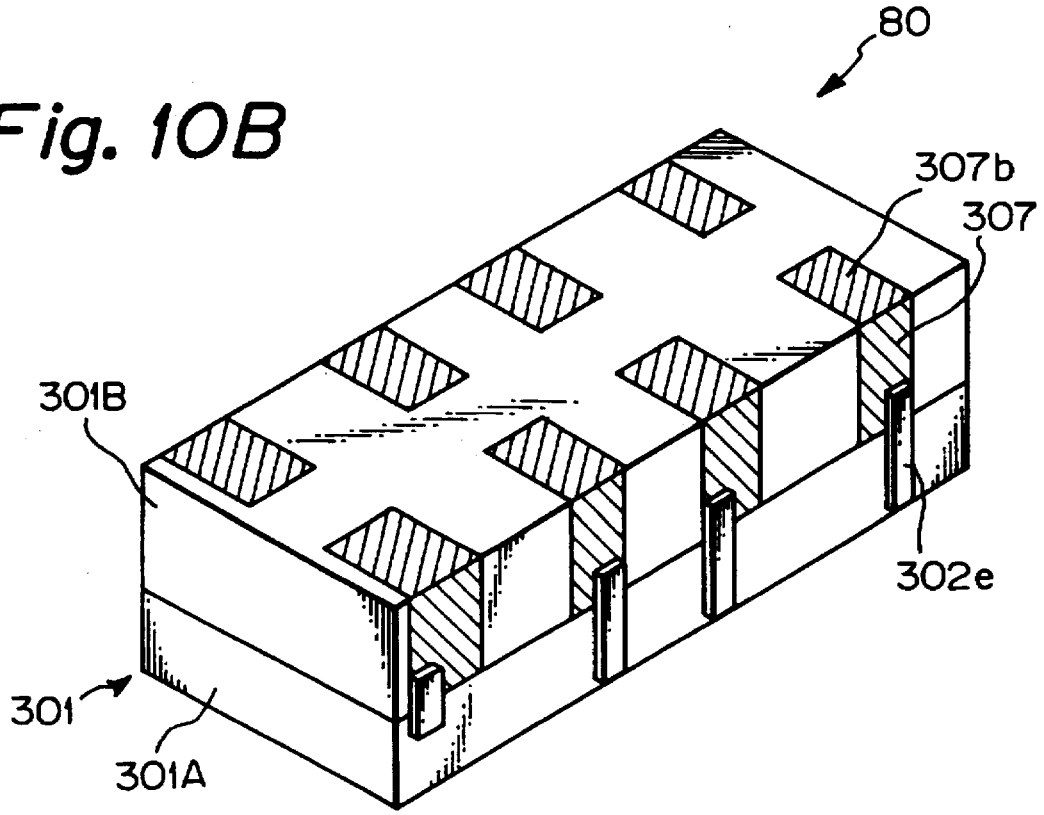

FIGS. 10A and 10B show a fifth embodiment of the present invention. FIG. 10A shows a relay 80 as seen from above while FIG. 10B shows it as seen from below and in which the cover 500 is absent. As shown, this embodiment differs from the first embodiment of FIGS. 4A and 4B in that the base 301 is made up of an upper base 301A and a lower base 301B, and in that the surface terminals 307 are formed on the surfaces of the lower base 301B by plating, metal thin film application or similar technology. The tongues 302*e* extending from the stationary contact terminals 302 are each bent downward to contact the associated surface terminal 307. The portions of the terminals 307 contacting the bottom of the lower base 301B constitute the extensions 307*b*. The electrical and mechanical connection between the tongues 302*e* and the terminals 307 may be implemented by the configuration shown in FIGS. 7A, 7B and 8A–8D or the configuration shown in FIGS. 9A and 9B, as desired.

Figure 11A:
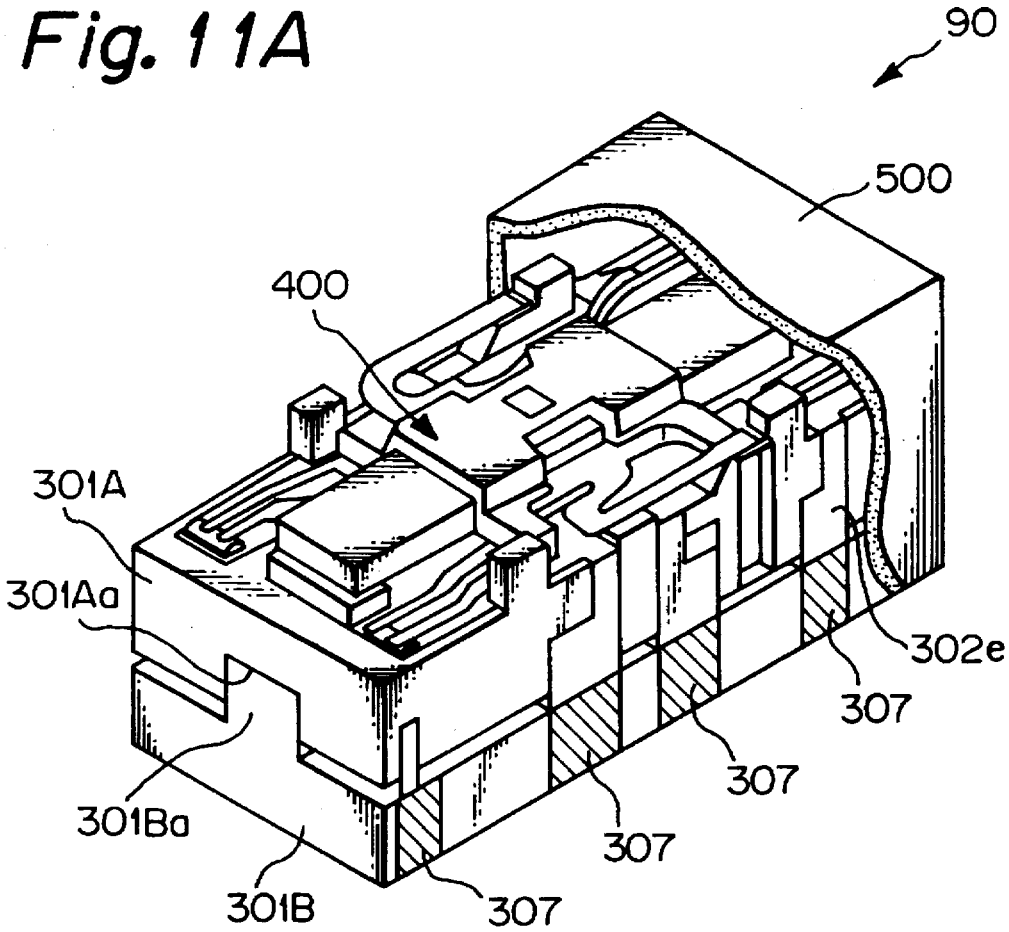
FIG. 11A is a perspective view showing a sixth embodiment of the present invention.
Figure 11B:
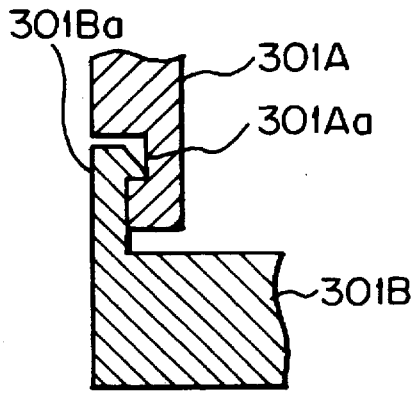
FIGS. 11B and 11C are fragmentary sections showing the sixth embodiment.
Figure 11C:
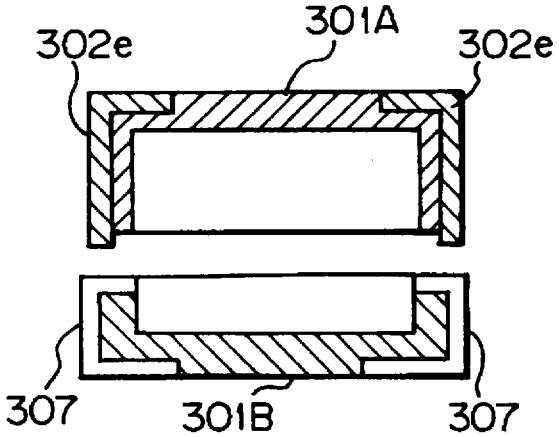

FIGS. 11A–11C show a sixth embodiment of the present invention. This embodiment is similar to the fifth embodiment of FIGS. 10A and 10B except for the following. As shown, a relay 90 has the surface terminals 307 formed on the top, sides and bottom of the lower base 301B. The upper base 301A and lower base 301B respectively have locking portions 301Aa and 301Ba at their edges facing each other. As shown in FIG. 11B, the coupling portions 301Aa and 301Ba are engaged with each other so as to cause the lower ends of the tongues 302*e* extending from the terminals 302 to contact the surface terminals 307. As shown in FIG. 11C, the tongues 302*e* protrude downward from the edges of the upper base 301A and electrically contact the surface terminals 307. It is to be noted that the configuration, position and number of the locking portions 301Aa and 301Ba are open to choice.

Figure 12:
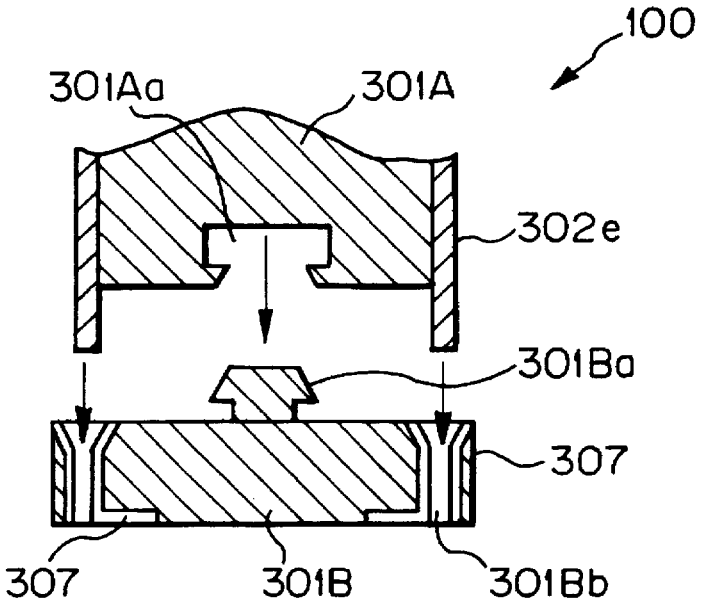
FIG. 12 is a section showing a seventh embodiment of the present invention.

FIG. 12 shows a seventh embodiment of the present invention, particularly the upper base 301A and lower base 301B. This embodiment is similar to the sixth embodiment of FIGS. 11A–11C except for the following. As shown, a relay 100 has the lower base 301B formed with through bores 301Bb. The surface terminals 307 are each provided on the wall of the respective bore 301Bb. The tongues 302*e* extending downward from the edges of the upper base 301A are passed throughout the bores 301Bb and mechanically supported thereby. At the same time, the tongues 302*e* are electrically connected to the surface terminals 307. To insure the contact of the tongues 302*e* with the terminals 307, the upper base 301A and lower base 301B respectively have the locking portions 301Aa and 301Ba at their edges facing each other. The tongues 302*e* and bores 301Bb may each be provided with any desired shape and dimensions. The bores 301Bb may be implemented as grooves, if desired. In addition, the shape, position and number of the locking portions 301Aa and 301Ba are open to choice.

Figure 13:
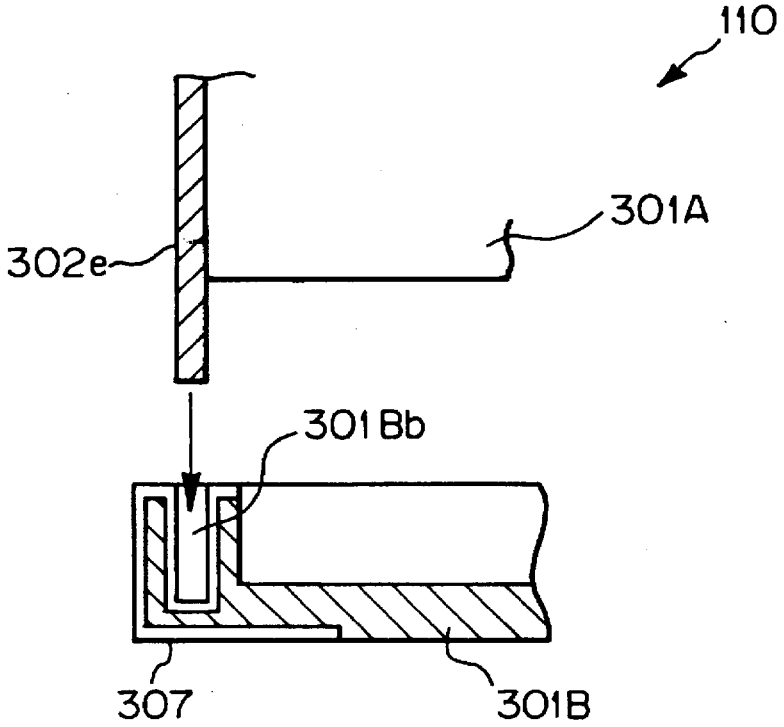
FIG. 13 is a section showing an eighth embodiment of the present invention.

FIG. 13 shows an eighth embodiment of the present invention, particularly the upper base 301A and lower base 301B. This embodiment is similar to the seventh embodiment of FIG. 12 except for the following. As shown, a relay 110 has the surface terminals 307 each extending from the wall of the associated through bore 301Bb over to the bottom of the lower base 301B by way of the side of the base 301B. This embodiment is identical in effect with the seventh embodiment. The bores 301Bb may not be through or may even be replaced with grooves, if desired.

Figure 2:
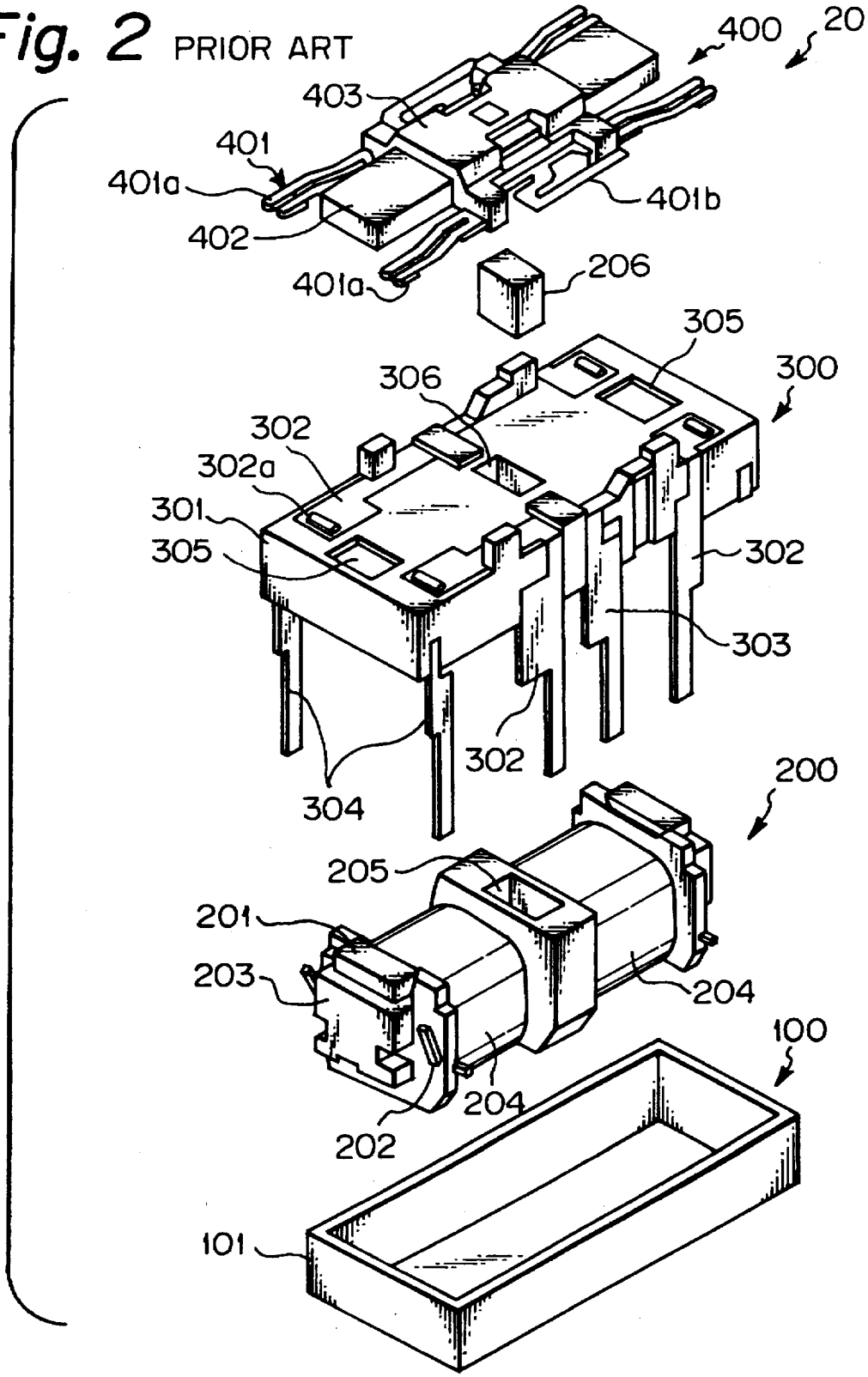
Fig. 2 PRIOR ART
FIG. 2 is an external view of another conventional electromagnetic relay.

The above embodiments have concentrated on the basic relay configuration shown in FIGS. 2 and 3. However, because the gist of the present invention is the terminal structure, the base may be provided with a top-open box-Like configuration for receiving the coil assembly therein.

In summary, it will be seen that the present invention provides a surface mount type leadless electromagnetic relay which eliminates the need for conventional gull-wing terminals. Hence, the entire relay has a height and a mounting area which are respectively equal to the height and mounting area of its body.

Various modifications will become possible for those skilled in the art after receiving the teachings of the present disclosure without departing from the scope thereof.

What is claimed is:

1. A surface mount type leadless electromagnetic relay comprising:

a coil assembly comprising an iron core, a coil spool containing said iron core such that said iron core is partly exposed to an outside, and coils wound round said coil spool;

an armature assembly comprising an armature contacting at least one end portion of said iron core at one end portion thereof, movable contact springs each having at least one movable contact at an end thereof, and a support formed of an insulating material and supporting said armature and said movable contact springs;

a terminal assembly comprising terminals including stationary contact terminals each holding at least one stationary contact facing said at least one movable contact; and a base formed of an insulating material and accommodating said coil assembly therein;

wherein said at least one movable contact, said movable contact springs, said at least one stationary contact and said terminals of said terminal assembly, which are electrically connected to external circuit from said coils are formed integrally with said base and held in close contact with a bottom of a body of said relay.

2. A relay as claimed in claim 1, wherein said base comprises a bottom-open box-like upper base, and a top-open box-like lower base.

3. A relay as claimed in claim 1, wherein said base comprises a substantially parallelepiped base molded integrally with said coil assembly.

4. A relay as claimed in claim 1, wherein said base comprises a top-open box-like casing.

5. A relay as claimed in claim 1, wherein an integral assembly of said terminals of said terminal assembly and said base is formed by mechanically bending said terminals and then insertion-molding said base.

6. A relay as claimed in claim 1, wherein an integral assembly of said terminals of said terminal assembly and said base is formed by mechanically and electrically connecting surface terminals formed on a surface of said base in a preselected pattern by one of plating and metal film application, and said movable contact springs, said at least one stationary contact, and said terminals of said terminal assembly.

7. A relay as claimed in claim 6, wherein an integral assembly of said terminals of said terminal assembly and said base is formed by press-fitting said terminals of said terminal assembly in said surface terminals.

8. A relay as claimed in claim 6, wherein an integral assembly of said terminals of said terminal assembly and said base is formed by contact of said terminals with said surface terminals provided on said base.

9. A relay as claimed in claim 8, wherein press-fitting of said terminals in said surface terminals is reinforced by a cover.

10. A relay as claimed in claim 8, wherein press-fitting of said terminals in said surface terminals is reinforced by a cover, and wherein a sealant is injected into clearances between said base and said cover.

11. A relay as claimed in claim 6, wherein an integral assembly of said terminals of said terminal assembly and said base is formed by causing said terminals to pierce said surface terminals.

12. A surface mount type leadless electromagnetic relay comprising:

a coil assembly comprising an iron core, a coil spool containing said iron core such that said iron core is partly exposed to an outside, and coils wound round said coil spool;

an armature assembly comprising an armature contacting at least one end portion of said iron core at one end portion thereof, movable contact springs each having at least one movable contact at an end thereof, and a support formed of an insulating material and supporting said armature and said movable contact springs;

a terminal assembly comprising terminals including stationary contact terminals each holding at least one stationary contact facing said at least one movable contact;

an upper base formed of an insulating material and accommodating said coil assembly; and a lower base formed of an insulating material, and having on a surface thereof surface terminals formed in a preselected pattern by one of plating and metal film application and corresponding to said at least one movable contact, said movable contact springs, said at least one stationary contact, and said terminals of said terminal assembly electrically connected to external circuitry from said coils;

wherein said upper base and said lower base are mechanically and electrically connected to each other, and wherein said surface terminals are extended to a bottom of a body of said relay.

13. A relay as claimed in claim 12, wherein electrical connection of said upper base and said lower base is set up by contact of said surface terminals and said terminals of said terminal assembly.

14. A relay as claimed in claim 12, wherein electrical connection of said upper base and said lower base is set up by causing said terminals of said terminal assembly to pierce said surface terminals.

15. A relay as claimed in claim 12, wherein electrical and mechanical contact of said upper base and said lower base is set up by engagement of said upper base and said lower base.

16. A relay as claimed in claim 12, wherein electrical and mechanical connection of said upper base and said lower base is set up by contact of said terminals of said terminal assembly and said surface terminals each being provided on a wall of a through hole formed in said lower base, and wherein said terminals of said terminal assembly each extends throughout said through hole.

* * * * *